US010376928B2

(12) United States Patent
Osajima et al.

(10) Patent No.: US 10,376,928 B2
(45) Date of Patent: Aug. 13, 2019

(54) CLEANING BLADE

(71) Applicants: NOK CORPORATION, Tokyo (JP); SYNZTEC CO., LTD., Tokyo (JP)

(72) Inventors: Takeshi Osajima, Kanagawa (JP); Shuang Wang, Kanagawa (JP); Shuji Abe, Kanagawa (JP); Hiroyuki Sato, Kanagawa (JP)

(73) Assignee: SYNZTEC CO., LTD., Tokyo (JP)

( * ) Notice: Subject to any disclaimer, the term of this patent is extended or adjusted under 35 U.S.C. 154(b) by 51 days.

(21) Appl. No.: 15/550,040

(22) PCT Filed: Jun. 21, 2016

(86) PCT No.: PCT/JP2016/068439
§ 371 (c)(1),
(2) Date: Aug. 10, 2017

(87) PCT Pub. No.: WO2016/208601
PCT Pub. Date: Dec. 29, 2016

(65) Prior Publication Data

US 2018/0043399 A1 Feb. 15, 2018

(30) Foreign Application Priority Data

Jun. 24, 2015 (JP) ..... 2015-127045

(51) Int. Cl.
*B08B 1/00* (2006.01)
*B41J 29/17* (2006.01)
*G03G 21/00* (2006.01)

(52) U.S. Cl.
CPC ..... *B08B 1/005* (2013.01); *B41J 29/17* (2013.01); *G03G 21/0017* (2013.01)

(58) Field of Classification Search
CPC ..... B08B 1/00; B08B 1/005; G03G 15/161; G03G 9/08
See application file for complete search history.

(56) References Cited

U.S. PATENT DOCUMENTS

2004/0246687 A1* 12/2004 Abe ..... G06F 1/18 361/752
2007/0140762 A1 6/2007 Ueno et al.
(Continued)

FOREIGN PATENT DOCUMENTS

JP 2005-148403 6/2005
JP 2007-052062 3/2007
(Continued)

OTHER PUBLICATIONS

International Search Report, PCT/JP2016/068439, dated Aug. 2, 2016.
(Continued)

*Primary Examiner* — Michael D Jennings
(74) *Attorney, Agent, or Firm* — Young & Thompson

(57) ABSTRACT

Disclosed is a cleaning blade, having an elastic body formed of a rubber base material molded product, and a surface treatment layer on at least an area of the elastic body to be brought into contact with a cleaning object. The surface treatment layer is formed by impregnating a surface portion of the elastic body with a surface treatment liquid containing an isocyanate compound and an organic solvent, and hardening the liquid. The surface treatment layer has an indentation elastic modulus of 21 MPa to 56 MPa. The elastic body has an indentation elastic modulus greater than 20 MPa and 35 MPa or less. The difference in indentation elastic modulus between the surface treatment layer and the elastic body is 1 MPa to 21 MPa.

8 Claims, 1 Drawing Sheet

(56) References Cited

U.S. PATENT DOCUMENTS

| | | | | |
|---|---|---|---|---|
| 2008/0027184 | A1* | 1/2008 | Ueno | C08G 18/3868<br>525/459 |
| 2009/0003905 | A1* | 1/2009 | Ueno | G03G 21/0017<br>399/350 |

FOREIGN PATENT DOCUMENTS

| | | |
|---|---|---|
| JP | 2007-193306 | 8/2007 |
| JP | 2009-063993 | 3/2009 |
| JP | 2010-152295 | 7/2010 |
| JP | 2010-210879 | 9/2010 |
| JP | 2011-053659 | 3/2011 |
| JP | 2011-180424 | 9/2011 |

OTHER PUBLICATIONS

Extended European Search Report for Application No. 16814371.7, dated Jan. 21, 2019.

* cited by examiner

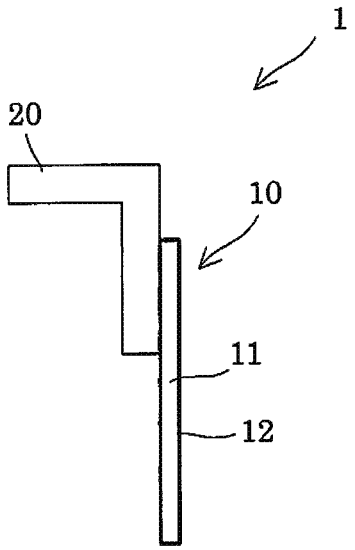
1
20
10
11
12

CLEANING BLADE

TECHNICAL FIELD

The present invention relates to a cleaning blade employed in image-forming apparatuses such as an electrophotographic copying machine or printer and a toner-jet-type copying machine or printer.

BACKGROUND ART

In a general electrophotographic process, an electrophotographic photoreceptor undergoes processes including at least cleaning, charging, light exposure, development, and image transfer. Each process employs a cleaning blade for removing toner remaining on the surface of a photoreceptor drum, a conductive roller for uniformly imparting electric charge to the photoreceptor, a transfer belt for transferring a toner image, and the like. From the viewpoints of plastic deformation and wear resistance, the cleaning blade is usually produced from a thermosetting polyurethane resin.

However, when a cleaning blade formed of polyurethane resin is used, the friction coefficient between a blade member and a photoreceptor drum increases, whereby defoliation of the blade or generation of anomalous sounds occurs. Also, in some cases, the drive torque of the photoreceptor drum must be increased. Furthermore, the edge of a cleaning blade is caught in a photoreceptor drum or the like, resulting in drawing and cutting, whereby the edge of the cleaning blade may be damaged through wearing.

In order to solve such problems, efforts have been made for imparting higher hardness and lower friction to a contact part of the polyurethane blade. In one proposed method, a polyurethane-made blade is impregnated with an isocyanate compound, to thereby cause reaction between the polyurethane resin and the isocyanate compound, whereby the hardness of the surface and a portion thereof in the vicinity of the polyurethane resin blade is selectively reduced, and their friction is increased (see, for example, Patent Document 1).

However, when the surface hardness of the blade is enhanced, chipping of the blade problematically occurs. Also, although reducing the friction of the blade surface can prevent occurrence of filming (i.e., a phenomenon of toner adhering onto a photoreceptor drum), undesired release of toner tends to occur, problematically resulting in cleaning failure.

Another proposed cleaning blade has specific properties including dynamic hardness and friction coefficient of the polyurethane resin blade surface (see, for example, Patent Documents 2 to 5). However, even though properties including dynamic hardness and friction coefficient of the polyurethane resin blade surface are limited, a satisfactory blade has not been always realized, and generation of chipping and filming after long-term use cannot be satisfactorily suppressed.

Meanwhile, the performance required for a cleaning blade employed in a conventional printer or the like differs from that required for a cleaning blade employed in a process cartridge. Therefore, a wide variety of materials must be provided for producing such cleaning blades of different types. Generally, the materials are required to have wear resistance, chipping resistance, photoreceptor surface wear resistance, and filming resistance.

PRIOR ART DOCUMENTS

Patent Documents

Patent Document 1: Japanese Patent Application Laid-Open (kokai) No. 2007-52062

Patent Document 2: Japanese Patent Application Laid-Open (kokai) No. 2010-152295

Patent Document 3: Japanese Patent Application Laid-Open (kokai) No. 2010-210879

Patent Document 4: Japanese Patent Application Laid-Open (kokai) No. 2009-63993

Patent Document 5: Japanese Patent Application Laid-Open (kokai) No. 2011-180424

SUMMARY OF THE INVENTION

Problems to be Solved by the Invention

In view of the foregoing, an object of the present invention is to provide a cleaning blade which has excellent chipping resistance and which realizes suppression of filming and enhancement of cleaning performance.

Means for Solving the Problems

In one mode of the present invention for solving the aforementioned problems, there is provided a cleaning blade, having an elastic body formed of a rubber base material molded product, and a surface treatment layer on at least an area of the elastic body to be brought into contact with a cleaning object, characterized in that:

the surface treatment layer is formed by impregnating a surface portion of the elastic body with a surface treatment liquid containing an isocyanate compound and an organic solvent, and hardening the liquid;

the surface treatment liquid concentration of the surface treatment layer has such a profile that the impregnation concentration gradually decreases from the surface toward the depth direction;

the surface treatment layer has an elastic modulus of 60 MPa or lower;

the elastic body has an elastic modulus of 3 MPa to 35 MPa;

the difference in elastic modulus between the surface treatment layer and the elastic body is 1 MPa to 25 MPa; and index M, which is calculated from a breaking elongation (%) of the elastic body at 23° C., a tan δ (1 Hz) peak temperature (° C.) of the elastic body, and an impregnation depth (μm) of the surface treatment liquid by the following formula:

Index $M$=[breaking elongation (%) of the elastic body at 23° C.]×[tan δ (1 Hz) peak temperature (° C.)]×(−1)/[impregnation depth (μm) of the surface treatment liquid] is 1 to 1,100.

According to the present invention, there can be realized a cleaning blade which has excellent chipping resistance and which realizes suppression of filming and enhancement of cleaning performance.

The aforementioned impregnation depth is preferably 10 μm to 600 μm. Also, the breaking elongation (i.e., elongation at break) (%) of the elastic body at 23° C. is preferably 250% to 450%.

The tan δ (1 Hz) peak temperature (° C.) of the elastic body is preferably lower than 0° C.

Effects of the Invention

The present invention realizes a cleaning blade which has excellent chipping resistance and which realizes suppression of filming and enhancement of cleaning performance.

BRIEF DESCRIPTION OF THE DRAWINGS

The sole drawing FIGURE illustrates a cross-section of an example of the cleaning blade according to the present invention.

MODES FOR CARRYING OUT THE INVENTION

The cleaning blade of the present invention for use in an image-forming device will next be described in detail.

Embodiment 1

As shown in the sole drawing FIGURE, a cleaning blade 1 has a blade main body (also referred to as "cleaning blade") 10, and a supporting member 20. The blade main body 10 is joined to the supporting member 20 by means of an adhesive (not illustrated). The blade main body 10 is formed of an elastic body 11, which is a molded product of a rubber base material. The elastic body 11 has a surface treatment layer 12 formed at a surface portion thereof. The surface treatment layer 12 is formed by impregnating the surface portion of the elastic body 11 with the surface treatment liquid and hardening the liquid. The surface treatment layer 12 may be formed on at least an area of the elastic body 11 to be brought into contact with a cleaning object. In Embodiment 1, the surface treatment layer 12 is formed on the entire surface of the elastic body 11 so as to serve as the surface portion.

The surface treatment layer 12 has an elastic modulus (hereinafter referred to as a bulk elastic modulus) of 60 MPa or lower, preferably 4 MPa to 60 MPa. When the elastic modulus of the surface treatment layer 12 is adjusted to exceed 60 MPa, the surface treatment layer 12 cannot follow deformation of the elastic body 11, resulting in chipping of the surface treatment layer 12. When the elastic modulus is lower than 4 MPa, the effect of forming the surface treatment layer cannot be fully attained.

The elastic modulus of the elastic body 11 is 3 MPa to 35 MPa. When the elastic modulus of the elastic body 11 is adjusted to be lower than 3 MPa, the contact target, which is a photoreceptor drum in Embodiment 1, receives elevated torque, thereby reducing the filming suppression effect. In contrast, when the elastic modulus of the elastic body 11 is adjusted to exceed 35 MPa, sufficient adhesion between the photoreceptor drum and the cleaning blade fails to be attained.

The difference in elastic modulus between the surface treatment layer 12 and the elastic body 11 is 1 MPa to 25 MPa. When the difference in elastic modulus between the surface treatment layer 12 and the elastic body 11 is smaller than 1 MPa, sufficient filming suppression effect fails to be attained. When the difference in elastic modulus is in excess of 25 MPa, chipping resistance decreases. Both cases are not preferred, and thus the above range is selected.

As described above, the elastic modulus of the surface treatment layer 12 is 60 MPa or lower, preferably 4 MPa to 60 MPa; the elastic modulus of the elastic body 11 is 3 MPa to 35 MPa; the difference in elastic modulus between the surface treatment layer 12 and the elastic body 11 is 1 MPa to 25 MPa; and the index M, defined by the following formula, is 1 or higher. Although the details will be described below, under the above conditions, the cleaning blade 1 realizes all of excellent chipping resistance, suppression of filming, and enhancement in cleaning performance.

The index M is defined by the following equation.

Index $M$=[breaking elongation (%) of the elastic body at 23° C.]×[tan δ (1 Hz) peak temperature (° C.)]×(−1)/[impregnation depth (μm) of the surface treatment liquid]

In the above equation, the breaking elongation (%) of the elastic body at 23° C. is determined at 23° C. in accordance with JIS K6251 (2010).

The breaking elongation (%) of the elastic body at 23° C. is an important factor which determines the chipping resistance and the impregnation depth (μm) of the surface treatment liquid. That is, the breaking elongation has a close relationship with chipping resistance.

The breaking elongation (%) of the elastic body at 23° C. is preferably 250% to 450%, more preferably 300% to 450%.

The tan δ (1 Hz) peak temperature (° C.) is measured by means of a DMS viscoelastic spectrometer at 1 Hz in a thermogravimetric analyzer EXSTAR 6000 (product of SEIKO Instruments Inc.).

A tan δ-temperature curve shows glass-rubber transition behavior and is important means for determining chipping resistance. The tan δ temperature is preferably lower than 0° C.

The surface treatment liquid impregnation depth serves as an index for the depth of a portion of the elastic body which has been impregnated with the surface treatment liquid from the surface of the elastic body. Therefore, the surface treatment liquid impregnation depth may coincide with the thickness of the surface treatment layer. However, the thickness of the surface treatment layer cannot be defined unequivocally.

In the present invention, the impregnation depth is defined as follows.

The surface treatment liquid impregnation depth is measured by means of Dynamic Ultra Micro Hardness Tester DUH-201 (product of Shimadzu Corporation) according to JIS 22255 and ISO 14577. Firstly, a rubber elastic body is cut, and the elastic modulus profile from the cut surface to the inside of the rubber elastic body is measured. Separately, another elastic body is subjected to the surface treatment. Then, the rubber elastic body is cut, and the elastic modulus profile from the cut surface to the inside of the rubber elastic body is measured. The elastic modulus at a depth of 10 μm from the cut surface of the untreated elastic body, and the elastic modulus at a depth of 10 μm from the cut surface of the surface-treated elastic body are determined. The percent change between the two values is defined as 100%. The depth where the percent change in elastic modulus from the cut surface becomes 0% is determined. The thus-determined depth (length) from the surface is employed as an impregnation depth (μm).

The impregnation depth is preferably 10 to 600 μm, more preferably 10 to 300 μm.

In the present invention, the index M is 1 to 1,100, preferably 1 to 250. The index M is defined as described above. In consideration of breaking elongation and tan δ, which determines the chipping resistance of the elastic body 11, the elastic body 11 is preferably formed of a rubber base material having greater breaking elongation and tan δ. Since the surface of such a material can be easily impregnated with the surface treatment liquid, the impregnation depth of the surface treatment layer 12 must be appropriately regulated, to thereby enhance chipping resistance. The aforementioned preferred range of the index M is determined in consideration of the above conditions.

Thus, excellent chipping resistance, suppression of filming, and enhancement in cleaning performance can all be ensured, through controlling, to fall within specific ranges, the elastic modulus of the surface treatment layer 12, the elastic modulus of the elastic body 11, the difference in elastic modulus therebetween, and the index M.

The surface treatment layer 12 having a very small thickness can be formed at a surface portion of the elastic body 11 by use of a surface treatment liquid having high affinity to the elastic body 11. By use of such a surface treatment liquid, the elastic body 11 can be readily impregnated with the surface treatment liquid, whereby residence of an excess amount of surface treatment liquid on the surface of the elastic body 11 can be prevented. Thus, a conventionally employed removal step of removing an excessive isocyanate compound can be omitted.

The surface treatment liquid for forming the surface treatment layer 12 contains an isocyanate compound and an organic solvent. Examples of the isocyanate compound contained in the surface treatment liquid include isocyanate compounds such as tolylene diisocyanate (TDI), 4,4'-diphenylmethane diisocyanate (MDI), p-phenylene diisocyanate (PPDI), naphthylene diisocyanate (NDI), and 3,3'-dimethylbiphenyl-4,4'-diyl diisocyanate (TODI), and oligomers and modified products thereof.

As the surface treatment liquid, there is preferably used a mixture of an isocyanate compound, a polyol, and an organic solvent, or a mixture of a prepolymer having isocyanate groups and an organic solvent. The prepolymer is an isocyanate-group-containing compound which is produced by reacting an isocyanate compound with a polyol and which has an isocyanate group at an end thereof. Among such surface treatment liquids, more preferred surface treatment liquids are a mixture of a bi-functional isocyanate compound, a tri-functional polyol, and an organic solvent; and a mixture of an organic solvent and an isocyanate-group-containing prepolymer obtained through reaction between a bi-functional isocyanate compound and a tri-functional polyol. In the case where a mixture of a bi-functional isocyanate compound, a tri-functional polyol, and an organic solvent is used, the bi-functional isocyanate compound reacts with the tri-functional polyol in the step of impregnating the surface portion with the surface treatment liquid, whereby an isocyanate-group-containing prepolymer having an isocyanate group at an end thereof is produced. The prepolymer is hardened and reacts with the elastic body 11.

Thus, by use of a surface treatment liquid which allows formation of an isocyanate-group-containing prepolymer via reaction between a bi-functional isocyanate compound and a tri-functional polyol, or a surface treatment liquid containing an isocyanate-group-containing prepolymer, the formed surface treatment layer 12 exhibits high hardness and low friction, even though it is a thin layer. As a result, chipping resistance, suppression of filming, and excellent cleaning performance can be attained. Notably, the surface treatment liquid is appropriately selected in consideration of wettability to the elastic body 11, the degree of immersion, and the pot life of the surface treatment liquid.

Examples of the bi-functional isocyanate compound include 4,4'-diphenylmethane diisocyanate (MDI), isophorone diisocyanate (IPDI), 4,4'-dicyclohexylmethane diisocyanate (H-MDI), trimethylhexamethylene diisocyanate (TMHDI), tolylene diisocyanate (TDI), carbodiimide-modified MDI, polymethylene polyphenyl polyisocyanate, 3,3'-dimethylbiphenyl-4,4'-diyl diisocyanate (TODI), naphthylene diisocyanate (NDI), xylene diisocyanate (XDI), lysine diisocyanate methyl ester (LDI), dimethyl diisocyanate, and oligomers and modified products thereof. Among bi-functional isocyanate compounds, those having a molecular weight of 200 to 300 are preferably used. Among the above isocyanate compounds, 4,4'-diphenylmethane diisocyanate (MDI) and 3,3'-dimethylbiphenyl-4,4'-diyl diisocyanate (TODI) are preferred. Particularly when the elastic body 11 is formed of polyurethane, the bi-functional isocyanate compound has high affinity to polyurethane, whereby integration of the surface treatment layer 12 and the elastic body 11 via chemical bonding can be further enhanced.

Examples of the tri-functional polyol include tri-hydric aliphatic polyols such as glycerin, 1,2,4-butanetriol, trimethylolethane (TME), trimethylolpropane (TMP), and 1,2,6-hexanetriol; polyether triols formed through addition of ethylene oxide, butylene oxide, or the like to tri-hydric aliphatic polyols; and polyester triols formed through addition of a lactone or the like to tri-hydric aliphatic polyols. Among tri-hydric aliphatic polyols, those having a molecular weight of 150 or lower are preferably used. Among the above tri-functional polyols, trimethylolpropane (TMP) is preferably used. When a tri-functional polyol having a molecular weight of 150 or lower is used, reaction with isocyanate proceeds at high reaction rate, whereby a surface treatment layer with high hardness can be formed. Also, when a surface treatment liquid containing a tri-hydric polyol is used, three hydroxyl groups react isocyanate groups, to thereby yield the surface treatment layer 12 having high cross-link density attributed to a 3-dimensional structure.

No particular limitation is imposed on the organic solvent, so long as it can dissolve an isocyanate compound and a polyol, and a solvent having no active hydrogen which reacts with the isocyanate compound is suitably used. Examples of the organic solvent include methyl ethyl ketone (MEK), methyl isobutyl ketone (MIBK), tetrahydrofuran (THF), acetone, ethyl acetate, butyl acetate, toluene, and xylene. The lower the boiling point of the organic solvent, the higher the solubility. By use of a low-boiling-temperature solvent, drying after impregnation can be completed rapidly, thereby attaining uniform treatment. Notably, the organic solvent is chosen from these organic solvents in consideration of the degree of swelling of the elastic body 11. From this viewpoint, methyl ethyl ketone (MEK), acetone, and ethyl acetate are preferably used.

The elastic body 11 is formed of a matrix having active hydrogen. Examples of the rubber base material forming the matrix having active hydrogen include polyurethane, epichlorohydrin rubber, nitrile rubber (NBR), styrene rubber (SBR), chloroprene rubber, and ethylene-propylene-diene rubber (EPDM). Of these, polyurethane is preferred, from the viewpoint of reactivity to the isocyanate compound.

Examples of the rubber base material formed of polyurethane include those mainly comprising at least one species selected from among aliphatic polyethers, polyesters, and polycarbonates. More specifically, such a rubber base material is mainly formed of a polyol containing at least one species selected from among aliphatic polyethers, polyesters, and polycarbonates, the polyol molecules being bonded via urethane bond. Examples of preferred polyurethanes include polyether-based polyurethane, polyester-based polyurethane, and polycarbonate-based polyurethane. Alternatively, a similar elastic body employing polyamide bond, ester bond, or the like, instead of urethane bond, may also be used. Yet alternatively, a thermoplastic elastomer such as polyether-amide or polyether-ester may also be used. Also, in addition to, or instead of a rubber base material having active hydrogen, a filler or a plasticizer having active hydrogen may be used.

The surface portion of the elastic body 11 is impregnated with the surface treatment liquid, and the liquid is hardened, to thereby form the surface treatment layer 12 at the surface portion of the elastic body 11. No particular limitation is imposed on the method of impregnating the surface portion of the elastic body 11 with the surface treatment liquid and hardening the liquid. In one specific procedure, the elastic body 11 is immersed in the surface treatment liquid, and then the elastic body is heated. In another procedure, the surface treatment liquid is sprayed onto the surface of the elastic body 11 for impregnation, and then the elastic body is heated. No particular limitation is imposed on the heating method, and examples include heating, forced drying, and natural drying.

More specifically, when a mixture of an isocyanate compound, a polyol, and an organic solvent is used as a surface treatment liquid, the surface treatment layer 12 is formed via reaction of the isocyanate compound with the polyol, to form a prepolymer concomitant with hardening, during impregnation of the surface portion of the elastic body 11 with the surface treatment liquid, and reaction of isocyanate groups with the elastic body 11.

In the case where a prepolymer is used as a surface treatment liquid, the isocyanate compound and the polyol present in the surface treatment liquid are caused to react in advance under specific conditions, to thereby convert the surface treatment liquid to a prepolymer having an isocyanate group at an end thereof. The surface treatment layer 12 is formed via impregnation of the surface portion of the elastic body 11 with the surface treatment liquid, and post hardening and reaction of isocyanate groups with the elastic body 11. Formation of the prepolymer from the isocyanate compound and the polyol may occur during impregnation of the surface portion of the elastic body 11 with the surface treatment liquid, and the extent of reaction may be controlled by regulating reaction temperature, reaction time, and the atmosphere of the reaction mixture. Preferably, the formation is performed at a surface treatment liquid temperature of 5° C. to 35° C. and a humidity of 20% to 70%. Notably, the surface treatment liquid may further contain a cross-linking agent, a catalyst, a hardening agent, etc., in accordance with needs.

The surface treatment layer 12 is formed on at least an area of the elastic body 11 to be brought into contact with a cleaning object. For example, the surface treatment layer 12 may be formed only on a front end area of the elastic body 11, or on the entire surface of the elastic body. Alternatively, after fabrication of a cleaning blade by bonding the elastic body 11 to the supporting member 20, the surface treatment layer 12 may be formed only on a front end area of the elastic body 11, or on the entire surface of the elastic body. Yet alternatively, the surface treatment layer 12 may be formed on one or both surfaces or the entire surface of a rubber molded product, before cutting the elastic body 11 into a blade shape, and then the rubber molded product is cut.

According to the present invention, through controlling the elastic modulus of the surface treatment layer 12, the elastic modulus of the elastic body 11, and the difference in elastic modulus therebetween to fall within specific ranges, there can be provided a cleaning blade which has excellent chipping resistance and realizes suppression of filming and enhancement in cleaning performance. In addition, through controlling the thickness of the surface treatment layer, excellent chipping resistance, suppression of filming, and enhancement in cleaning performance can be ensured.

EXAMPLES

The present invention will next be described in detail by way of examples, which should not be construed as limiting the invention thereto.

Firstly, cleaning blades of Examples 1 to 8 and Comparative Examples 1 to 3 were prepared. These cleaning blades differ in the elastic modulus values of their surface treatment layers, elastic modulus values of their elastic bodies (hereinafter referred to as rubber elastic bodies), or differ in elastic modulus therebetween.

Example 1

Production of Rubber Elastic Body

An ester-based polyol (molecular weight: 2,000) (100 parts by mass) serving as the polyol, and 4,4'-diphenylmethane diisocyanate (MDI) (53 parts by mass) serving as the isocyanate compound were allowed to react at 115° C. for 20 minutes. Subsequently, 1,4-butanediol (10.4 parts by mass) and trimethylolpropane (3.4 parts by mass), serving as cross-linking agents, were added thereto, and the mixture was transferred to a metal mold maintained at 140° C. and heated for hardening for 40 minutes. Then, the product was centrifuged, and cut to pieces of the rubber elastic body having dimensions of 15.0 mm in width, 2.0 mm in thickness, and 350 mm in length. The thus-obtained rubber elastic body pieces were found to have an elastic modulus of 13.5 MPa.

Preparation of Surface Treatment Liquid

MDI (product of Nippon Polyurethane Industry Co., Ltd., molecular weight: 250.25) (7.7 parts by mass), TMP (product of Nippon Polyurethane Industry Co., Ltd., molecular weight: 134.17) (2.3 parts by mass), and MEK (90 parts by mass) were mixed together, to thereby prepare a surface treatment liquid having a concentration of 10%.

Surface Treatment of Rubber Elastic Body

While the surface treatment liquid was maintained at 23° C., the rubber elastic body was immersed in the surface treatment liquid for 10 seconds. The thus-treated rubber elastic body was heated for one hour in an oven maintained at 50° C. Thereafter, the surface-treated rubber elastic body was attached to a supporting member, to thereby fabricate a cleaning blade. The thus-obtained cleaning blade had a surface treatment layer having an elastic modulus of 17.3 MPa and an impregnation depth of 200 μm, and exhibited a difference in elastic modulus between the surface treatment layer and the rubber elastic body of 3.8 MPa.

The elastic modulus of the surface treatment layer and that of the rubber elastic body were indentation elastic modulus values as determined according to ISO 14577. The indentation elastic modulus was measured through a load-unload test by means of Dynamic Ultra Micro Hardness Tester DUH-201 (product of Shimadzu Corporation) under the following conditions: retention time (5 s), maximum test load (0.50 N), loading speed (0.15 N/s), and indentation depth (3 μm to 10 μm). The measurement samples were cut from the same rubber sheet as produced for providing the cleaning blade. The indentation elastic modulus of the surface treatment layer was determined through the following procedure. Specifically, a test piece (40 mm×12 mm)

was cut from a central part of the rubber elastic body having a surface treatment layer, and affixed on a glass slide with double-sided tape such that the mirror surface (i.e., the surface opposite the mold-contact surface upon centrifugal molding) faced upwardly. The thus-affixed test piece was allowed to stand in a thermostat bath controlled at 23° C. for 30 to 40 minutes. Elastic modulus was measured at 20 positions 30 μm apart from the edge line (i.e., a longitudinal side of the sample) and in parallel to the edge line at the center along the longitudinal direction of the measurement sample. The 20 measurements were averaged. The indentation elastic modulus of the rubber elastic body was measured by use of a sample cut from the corresponding rubber elastic body before formation of the surface treatment layer.

The surface treatment liquid impregnation depth was measured by means of Dynamic Ultra Micro Hardness Tester DUH-201 (product of Shimadzu Corporation) according to JIS 22255 and ISO 14577. Firstly, a rubber elastic body was cut, and the elastic modulus profile from the cut surface to the inside of the rubber elastic body was measured. Separately, another elastic body was subjected to the surface treatment. Then, the rubber elastic body was cut, and the elastic modulus profile from the cut surface to the inside of the rubber elastic body was measured. The elastic modulus at a depth of 10 μm from the cut surface of the untreated elastic body, and the elastic modulus at a depth of 10 μm from the cut surface of the surface-treated elastic body were determined. The percent change between the two values was defined as 100%. The depth where the percent change in elastic modulus from the cut surface became 0% was determined. The thus-determined depth (length) from the surface was employed as an impregnation depth (μm).

Example 2

The procedure of Example 1 was repeated, except that MDI (43 parts by mass), 1,4-BD (8.9 parts by mass), and TMP (1.6 parts by mass) were used, to thereby form a rubber elastic body. The thus-obtained rubber elastic body was found to have an elastic modulus of 14.3 MPa. The rubber elastic body was subjected to the same surface treatment as performed in Example 1, to thereby produce a cleaning blade having a surface treatment layer with an elastic modulus of 16.6 MPa and a thickness of 300 μm. The cleaning blade was found to have a difference in elastic modulus between the surface treatment layer and the rubber elastic body of 2.3 MPa.

Example 3

The procedure of Example 1 was repeated, except that MDI (49 parts by mass), 1,4-BD (8.7 parts by mass), and TMP (3.7 parts by mass) were used, to thereby form a rubber elastic body. The thus-obtained rubber elastic body was found to have an elastic modulus of 12.1 MPa. The rubber elastic body was subjected to the same surface treatment as performed in Example 1, to thereby produce a cleaning blade having a surface treatment layer with an elastic modulus of 14.0 MPa and a thickness of 450 μm. The cleaning blade was found to have a difference in elastic modulus between the surface treatment layer and the rubber elastic body of 1.9 MPa.

Example 4

The procedure of Example 1 was repeated, except that MDI (37 parts by mass), 1,4-BD (7.1 parts by mass), and TMP (1.3 parts by mass) were used, to thereby form a rubber elastic body. The thus-obtained rubber elastic body was found to have an elastic modulus of 10.6 MPa. The rubber elastic body was subjected to the same surface treatment as performed in Example 1, to thereby produce a cleaning blade having a surface treatment layer with an elastic modulus of 12.5 MPa and a thickness of 600 μm. The cleaning blade was found to have a difference in elastic modulus between the surface treatment layer and the rubber elastic body of 1.9 MPa.

Example 5

The procedure of Example 1 was repeated, except that caprolactone polyol (molecular weight: 2,000) (100 parts by mass), MDI (46 parts by mass), 1,4-BD (7.8 parts by mass), and TMP (3.4 parts by mass) were used, to thereby form a rubber elastic body. The thus-obtained rubber elastic body was found to have an elastic modulus of 10.4 MPa. The rubber elastic body was subjected to the same surface treatment as performed in Example 1, to thereby produce a cleaning blade having a surface treatment layer with an elastic modulus of 11.4 MPa and a thickness of 200 μm. The cleaning blade was found to have a difference in elastic modulus between the surface treatment layer and the rubber elastic body of 1.0 MPa.

Example 6

The procedure of Example 1 was repeated, except that MDI (60 parts by mass), 1,4-BD (11.6 parts by mass), and TMP (2.9 parts by mass) were used, to thereby form a rubber elastic body. The thus-obtained rubber elastic body was found to have an elastic modulus of 32.1 MPa. The rubber elastic body was subjected to a similar surface treatment to that performed in Example 1, except that a 15% surface treatment liquid composed of MDI (12.0 parts by mass), TMP (0.6 parts by mass), 1,3-propanediol (product of du Pont, molecular weight: 76.09) (2.4 parts by mass), and MEK (85.0 parts by mass) was used, to thereby produce a cleaning blade. The surface treatment layer of the cleaning blade was found to have an elastic modulus of 42.8 MPa and a thickness of 50 μm. The difference in elastic modulus between the surface treatment layer and the rubber elastic body was 10.7 MPa.

Example 7

The procedure of Example 6 was repeated, to thereby form a rubber elastic body. The rubber elastic body was subjected to the same surface treatment as performed in Example 6 twice, to thereby produce a cleaning blade having a surface treatment layer with an elastic modulus of 56.8 MPa and a thickness of 50 μm. The cleaning blade was found to have a difference in elastic modulus between the surface treatment layer and the rubber elastic body of 24.7 MPa.

Example 8

The procedure of Example 1 was repeated, except that MDI (43 parts by mass), 1,4-BD (5.2 parts by mass), and TMP (5.2 parts by mass) were used, to thereby form a rubber elastic body. The thus-obtained rubber elastic body was found to have an elastic modulus of 4.8 MPa. The rubber elastic body was subjected to a similar surface treatment to that performed in Example 1, except that a 20% surface treatment liquid composed of MDI (16.0 parts by mass), TMP (0.6 parts by mass), 1,3-propanediol (product of du Pont, molecular weight: 76.09) (3.4 parts by mass), and MEK (80.0 parts by mass) was used, to thereby produce a cleaning blade. The surface treatment layer of the cleaning blade was found to have an elastic modulus of 23.1 MPa and a thickness of 600 μm. The difference in elastic modulus between the surface treatment layer and the rubber elastic body was 18.3 MPa.

Comparative Example 1

The procedure of Example 4 was repeated, to thereby form a rubber elastic body. The rubber elastic body was subjected to no further surface treatment, to thereby produce a cleaning blade.

Comparative Example 2

The procedure of Example 1 was repeated, except that MDI (51 parts by mass), 1,4-BD (6.7 parts by mass), and TMP (4.7 parts by mass) were used, to thereby form a rubber elastic body. The rubber elastic body was subjected to the same surface treatment as performed in Example 1, to thereby produce a cleaning blade having a surface treatment layer with an elastic modulus of 13.7 MPa and a thickness of 450 μm. The cleaning blade was found to have a difference in elastic modulus between the surface treatment layer and the rubber elastic body of 1.9 MPa.

Comparative Example 3

The procedure of Example 6 was repeated, to thereby form a rubber elastic body. The rubber elastic body was subjected to the same surface treatment as performed in Example 6 thrice, to thereby produce a cleaning blade having a surface treatment layer with an elastic modulus of 62.0 MPa and a thickness of 50 μm. The cleaning blade was found to have a difference in elastic modulus between the surface treatment layer and the rubber elastic body of 29.9 MPa.

Test Example 1

<Elastic Modulus of Surface Treatment Layer and that of Rubber Elastic Body, and Difference in Elastic Modulus>

Each of the cleaning blades produced in the Examples 1 to 8 and Comparative Examples 1 to 3 was evaluated in terms of chipping resistance, filming suppression, and cleaning performance. The above evaluation was performed by means of a color MFP (A3 size, 55 sheets/minute).

Chipping resistance was evaluated by setting the cleaning blade in a cartridge, and carrying out printing for 100,000 sheets. After the printing job, in the case where no chipping or wearing or chipping was observed, the state was evaluated as "O." When slight chipping or wear was observed, the state was evaluated as "Δ." When any chipping or wear was observed, the state was evaluated as "X."

Filming suppression was also evaluated, by setting the cleaning blade in a cartridge, and carrying out printing for 100,000 sheets. After the printing job, in the case where no toner adhesion was observed, the state was evaluated as "O." When slight toner adhesion was observed, the state was evaluated as "Δ." When toner adhesion was observed, the state was evaluated as "X."

Cleaning performance was also evaluated, by setting the cleaning blade in a cartridge, and carrying out printing for 100,000 sheets. After the printing job, in the case where no toner remaining was observed, the state was evaluated as "O." When slight toner remaining was observed, the state was evaluated as "Δ." When any toner remaining was observed, the state was evaluated as "X." Table 1 shows the results.

With reference to Table 1, comparisons were made for Examples 1 to 8 with Comparative Examples 1 to 3. As shown in Table 1, the cleaning blades of Examples 1 to 8 exhibited an elastic modulus of the surface treatment layer of 60 MPa or lower (required value), an elastic modulus of the rubber elastic body higher than 3 MPa and 35 MPa or lower, and a difference in elastic modulus between the surface treatment layer and the rubber elastic body of 1 MPa to 25 MPa. All the cleaning blades of Examples 1 to 8 exhibited excellent chipping resistance (O), filming suppression (O), and cleaning performance (O). In contrast, the cleaning blade of Comparative Example 1, which underwent no surface treatment, exhibited fair chipping resistance (Δ) and poor filming suppression (X). The cleaning blade of Comparative Example 2, which had an index M lower than 1, exhibited poor chipping resistance (X). The cleaning blade of Comparative Example 3, which had an elastic modulus of the surface treatment layer greater than 60 MPa and a difference in elastic modulus between the surface treatment layer and the rubber elastic body greater than 21 MPa, exhibited poor chipping resistance (X) and poor cleaning performance (X). As a result, through controlling the elastic modulus of the surface treatment layer, the elastic modulus of the rubber elastic body, and the difference in elastic modulus therebetween to fall within specific ranges (Examples 1 to 8), all of excellent chipping resistance, filming suppression, and enhancement in cleaning performance can be attained.

TABLE 1

| | Required range | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 |
|---|---|---|---|---|---|---|---|---|---|---|---|---|
| Elastic modulus of surface treatment layer | ≤60 MPa | 17.3 | 16.6 | 14.0 | 12.5 | 11.4 | 42.8 | 56.8 | 23.1 | 10.6 | 13.7 | 62.0 |
| Elastic modulus of rubber elastic body | 3-35 MPa | 13.5 | 14.3 | 12.1 | 10.6 | 10.4 | 32.1 | 32.1 | 4.8 | 10.6 | 11.8 | 32.1 |
| Difference in elastic modulus between surface treatment layer and rubber elastic body | 1-25 MPa | 3.8 | 2.3 | 1.9 | 1.9 | 1.0 | 10.7 | 24.7 | 18.3 | 0.0 | 1.9 | 29.9 |
| Thickness of surface treatment layer | 10-600 μm | 200 | 300 | 450 | 600 | 200 | 50 | 50 | 600 | 0 | 450 | 50 |

TABLE 1-continued

| | Required range | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 |
|---|---|---|---|---|---|---|---|---|---|---|---|---|
| Index M | 1-1100 | 5 | 21 | 3 | 18 | 4 | 11 | 11 | 3 | 0 | -1 | 11 |
| Breaking elongation [%] of elastic body | | 300 | 390 | 290 | 404 | 360 | 280 | 280 | 250 | 404 | 250 | 280 |
| tanδ [1 Hz] Peak temp. [° C.] | | −3 | −16 | −4 | −27 | −2 | −2 | −2 | −7 | −27 | 1 | −2 |
| Chipping resistance | | ○ | ○ | ○ | ○ | ○ | ○ | ○ | ○ | Δ | × | × |
| Filming suppression | | ○ | ○ | ○ | ○ | ○ | ○ | ○ | ○ | × | ○ | ○ |
| Cleaning performance | | ○ | ○ | ○ | ○ | ○ | ○ | ○ | ○ | ○ | ○ | × |

Index M = [breaking elongation (%) of the rubber elastic body] × [tanδ (1 Hz) peak temperature (° C.)] × (−1)/[impregnation depth (μm) of the surface treatment liquid]

INDUSTRIAL APPLICABILITY

The cleaning blade of the present invention is suited for a cleaning blade employed in image-forming apparatuses such as an electrophotographic copying machine or printer, and a toner-jet-type copying machine or printer. The cleaning blade of the present invention may find other uses, such as various blades and cleaning rollers.

DESCRIPTION OF REFERENCE NUMERALS

1 cleaning blade
10 blade main body
11 elastic body
12 surface treatment layer
20 supporting member

The invention claimed is:

1. A cleaning blade, having an elastic body formed of a rubber base material molded product, and a surface treatment layer on at least an area of the elastic body to be brought into contact with a cleaning object, characterized in that:

the surface treatment layer is formed by impregnating a surface portion of the elastic body with a surface treatment liquid containing an isocyanate compound and an organic solvent, and hardening the liquid;

the surface treatment liquid concentration of the surface treatment layer has such a profile that the impregnation concentration gradually decreases from the surface toward the depth direction;

the surface treatment layer has an elastic modulus of 60 MPa or lower;

the elastic body has an elastic modulus of 3 MPa to 35 MPa;

the difference in elastic modulus between the surface treatment layer and the elastic body is 1 MPa to 25 MPa; and index M, which is calculated from a breaking elongation (%) of the elastic body at 23° C., a tan δ (1 Hz) peak temperature (° C.) of the elastic body, and an impregnation depth (μm) of the surface treatment liquid by the following formula:

Index $M$=[breaking elongation (%) of the elastic body at 23° C.]×[tan δ (1 Hz) peak temperature (° C.)]×(−1)/[impregnation depth (μm) of the surface treatment liquid] is 1 to 1,100.

2. A cleaning blade according to claim 1, wherein the impregnation depth is 10 μm to 600 μm.

3. A cleaning blade according to claim 2, wherein the breaking elongation of the elastic body at 23° C. is 250% to 450%.

4. A cleaning blade according to claim 2, wherein the 1-Hz tan δ peak temperature of the elastic body is lower than 0° C.

5. A cleaning blade according to claim 3, wherein the 1-Hz tan δ peak temperature of the elastic body is lower than 0° C.

6. A cleaning blade according to claim 1, wherein the breaking elongation of the elastic body at 23° C. is 250% to 450%.

7. A cleaning blade according to claim 6, wherein the 1-Hz tan δ peak temperature of the elastic body is lower than 0° C.

8. A cleaning blade according to claim 1, wherein the 1-Hz tan δ peak temperature of the elastic body is lower than 0° C.

* * * * *